US012133582B1

(12) United States Patent
Djavanroodi et al.

(10) Patent No.: US 12,133,582 B1
(45) Date of Patent: Nov. 5, 2024

(54) SMART CANE FOR A VISUALLY IMPAIRED INDIVIDUAL

(71) Applicant: Prince Mohammad Bin Fahd University, Dhahran (SA)

(72) Inventors: Faramarz Djavanroodi, Dhahran (SA); Reem Albeloshi, Dhahran (SA); Lina Alfawaz, Dhahran (SA); Lamia Alshehri, Dhahran (SA); Kauther Aldoukhi, Dhahran (SA)

(73) Assignee: Prince Mohammad Bin Fahd University, Dhahran (SA)

( * ) Notice: Subject to any disclaimer, the term of this patent is extended or adjusted under 35 U.S.C. 154(b) by 0 days.

(21) Appl. No.: 18/677,218

(22) Filed: May 29, 2024

(51) Int. Cl.
*A45B 3/04* (2006.01)
*A45B 9/02* (2006.01)
*A45B 9/00* (2006.01)

(52) U.S. Cl.
CPC ..... *A45B 3/04* (2013.01); *A45B 9/02* (2013.01); *A45B 2009/002* (2013.01)

(58) Field of Classification Search
CPC ..... A61H 3/06; A61H 3/061; A61H 3/068; A45B 9/02
See application file for complete search history.

(56) References Cited

U.S. PATENT DOCUMENTS 4,858,125 A * 8/1989 Washizuka ..... A61H 3/061 135/65
5,097,856 A * 3/1992 Chi-Sheng ..... G01S 7/4813 704/271
6,489,605 B1 * 12/2002 Ritz ..... G01S 17/93 250/221
8,922,759 B2 * 12/2014 Gassert ..... A61H 3/068 356/3.01
9,826,806 B2 * 11/2017 Challa ..... A45B 3/02
11,000,442 B2 * 5/2021 Ramos ..... H04R 1/1041
(Continued)

FOREIGN PATENT DOCUMENTS

CN 104688498 A 6/2015
CN 213190991 U 5/2021
(Continued)

OTHER PUBLICATIONS

Ikbal et al. ; Smart walking stick for blind people: an application of 3D printer ; Proc. SPIE 10167, Nanosensors, Biosensors, Info-Tech Sensors and 3D Systems ; Apr. 24, 2017 ; 8 Pages.
(Continued)

*Primary Examiner* — Noah Chandler Hawk
(74) *Attorney, Agent, or Firm* — Oblon, McClelland, Maier & Neustadt, L.L.P.

(57) ABSTRACT

A smart cane for an individual includes a linear main frame rod (LMFR), a linear extending rod (LER) slidably connected to the LMFR, a load-bearing feet coupled to the LER, a top case assembly having a pivot connected to an end of the LMFR, and a hand grip coupled to an outer side of the top case assembly. A casing box of the top case assembly is in the form of an irregular hexagonal cell having an axis of symmetry that is coaxial with an axis of the hand grip. Two longest sides of the irregular hexagonal cell are opposite one another and two shortest sides of the irregular hexagonal cell are of equal length and are opposite one another.

18 Claims, 12 Drawing Sheets

(56) References Cited

U.S. PATENT DOCUMENTS

| | | | | |
|---|---|---|---|---|
| 2006/0028544 | A1* | 2/2006 | Tseng | A61H 3/068 348/62 |
| 2013/0113601 | A1* | 5/2013 | San Luis | G01S 13/93 340/4.1 |
| 2016/0321880 | A1 | 11/2016 | Hamam et al. | |
| 2019/0307633 | A1* | 10/2019 | Ceylan | A61H 3/068 |
| 2022/0160573 | A1* | 5/2022 | Taniguchi | A61H 3/061 |
| 2022/0280370 | A1* | 9/2022 | Higgins | A61H 1/00 |

FOREIGN PATENT DOCUMENTS

| | | |
|---|---|---|
| IN | 201921041852 | 11/2020 |
| IN | 202121013974 | 9/2021 |

OTHER PUBLICATIONS

Anas et al. ; Design and Analysis of an Intelligent Stick for Blind ; Islamic University of Technology ; Oct. 2014 ; 62 Pages.

Wang et al. ; Design and implementation of intelligent walking stick based on OneNET Internet of things development platform ; 2019 28$^{th}$ Wireless and Optical Communications Conference (WOCC) ; Jul. 25, 2019 ; 4 Pages.

* cited by examiner

SMART CANE FOR A VISUALLY IMPAIRED INDIVIDUAL

BACKGROUND

Technical Field

The present disclosure is directed to a smart assisting device for blind or visually impaired people, and more particularly, directed to a smart cane for an individual including the blind and/or visually impaired and a method of using the smart cane.

Description of Related Art

The "background" description provided herein is to present the context of the disclosure generally. Work of the presently named inventors, to the extent it is described in this background section, as well as aspects of the description that may not otherwise qualify as prior art at the time of filing, are neither expressly nor impliedly admitted as prior art against the present invention.

Persons with visual impairments have multiple impediments in their daily lives, particularly when it comes to mobility and navigation. Traditionally, walking canes have been the main form of aid for these people. The walking cane is a vital tool for helping people who are visually impaired to navigate their surroundings. Walking assistance devices for the visually impaired were first introduced as tactile assistance devices. Later, creation of mobility aids was particularly inspired from the first walking cane. The walking cane became a well-known representation of vision impairment, fostering understanding and acceptance. In the past, canes were mainly constructed of wood or metal and had few navigational features. In particular, the weight and length of a cane are important factors in giving a user stability and feedback. To optimize the cane's effectiveness, correct cane sizing and training are needed. Further, in the past, the walking cane was mostly used via touch and physical obstacle detection. People would move the cane back and forth in front of them to feel for changes in the terrain or impending obstacles. The walking cane is a tactile tool that may help users learn about their immediate environment and recognize potential dangers.

The walking cane has been a subject of constant research and development with emphasis on improving the usability, features, and safety of the walking cane. The need for better mobility aids has been highlighted by research on smart canes and assistive technology for people with visual impairments. Although earlier canes lacked sophisticated features and sensory feedback mechanisms, the present technological advancements in the walking cane domain utilize smart assistive technologies for the blind. Traditional walking canes were found to have weak obstacle detection abilities and were unable to detect objects at heights above ground level. Individuals with vision impairments are at risk because of this limitation, particularly in urban settings where low hanging branches and overhead obstructions are present.

In order to mitigate the above mentioned issues, incorporation of sensor technology into walking canes have been proposed. In particular, ultrasonic sensors have demonstrated potential in properly identifying barriers and giving users real-time feedback. Further, ultrasonic sensors provide obstacle detection, enabling visually impaired people to traverse their surroundings more successfully. Additionally, efforts have been made to improve functionality of smart canes by using computer vision techniques. Computer vision may help the visually impaired identify and avoid hazards in real-time. The development of smart canes has focused on navigation and localization methods in addition to sensor technology. Systems based on GPS offer precise positioning and guidance. In order to guarantee that the smart canes satisfies the unique needs and preferences of people who are visually impaired, user-centered design approaches have also been explored.

However, the present technological advancements in the field of smart walking canes have shortcomings in terms of delivering precise navigation and obstacle detection. Therefore, one object of the present disclosure is to provide a smart cane that offers visually impaired people precise obstacle detection and real-time help and support.

IN201921041852A describes a smart cane designed to cater to the visually challenged to make them independent, more conscious of their surroundings and able to move with the same ease as a sighted person. The smart cane may detect moving obstacles, elevation and depression, hot objects and slippery floors. An emergency module is present to email the user's location to a caretaker. The cane was designed to remain robust in all weather conditions and has a choice of switching between auditory feedback (via headphones) and haptic feedback for every functionality. Custom-made features like regional language options for auditory feedback and the ability to cater to different height groups includes a haptic feedback mode for alerting individuals with both hearing and visual impairment. Additionally, a flashlight module caters to individuals with complete visual impairment (by alerting others of their presence at night) and partial visual impairment (as a navigating aid at night). However, the above mentioned reference does not describe real-time, dynamic, and adaptive feedback with AI integration.

CN213190991U describes a utility model that claims a multifunctional blindman stick and communication locating system. The blindman stick or walking stick includes a crutch rod and a handle between the crutch rod. The handle is provided with an elastic buffer material. The crutch rod includes multiple sections of crutch, the crutch is telescopic connection with one side of the crutch rod close to a bottom end is provided with a distance measuring sensor group. The distance measuring sensor group is used for sending a detection signal to a measured target, and receiving the reflected signal formed by the detection signal reflected by the measured target. The crutch rod is provided with a microcontroller, a warning alarm, a GPS positioning device, a communication module, a storage module, and a battery module. The handle is provided with a keyboard and a temperature sensor. The utility model may use the principle of signal transmission detection and reflection control. The detection of a condition of an obstacle is notified by voice prompt to a blind, so as to bring convenience to the travel of the blind. The crutch rod improves safety and convenience of the blind. However, the above mentioned reference does not describe real-time, dynamic, and adaptive feedback with remote operation.

Accordingly, it is one object of the present disclosure to provide a smart cane and a method of using the smart cane, that may circumvent the aforementioned drawbacks such as inability to provide location assistance, real-time feedback, and AI integration to a visually impaired individual using the smart cane.

SUMMARY

In an exemplary embodiment, a smart cane for a blind and/or visually impaired individual, is described. The smart cane includes a linear main frame rod (LMFR) having a first end, a second end, and a first internal cavity. The smart cane further includes a linear extending rod (LER) having a first end, a second end, and a second internal cavity. In some embodiments, the second end of the LMFR is connected to the first end of the LER. The smart cane further includes a load-bearing feet disposed at the second end of the LER, a top case assembly having a pivot at a connection to the first end of the LMFR, and a hand grip operably coupled to an outer circumferential side of the top case assembly. In some embodiments, the hand grip is operably coupled to the LMFR via the top case assembly. In some embodiments, the hand grip and the top case assembly are movable relative to the LMFR, and a casing box of the top case assembly is in a form of an irregular hexagonal cell having an axis of symmetry that is coaxial with an axis of the hand grip. In some embodiments, the two longest sides of the irregular hexagonal cell are opposite one another and extend lengthwise down the axis of the hand grip sloping away from the axis of the hand grip. In some embodiments, the two shortest sides of the irregular hexagonal cell are of equal length and are opposite one another. In some embodiments, one of the two shortest sides of the irregular hexagonal cell is proximal to the hand grip, and the other of the two shortest sides of the irregular hexagonal cell is proximal to the first end of the LMFR. In some embodiments, the two shortest sides of the irregular hexagonal cell are perpendicular to the axis of the hand grip.

In some embodiments, the LMFR has a length in a range of 400 to 1600 millimeters (mm). In some embodiments, the LMFR has a cylindrical cross section having an inner diameter in a range of 5 to 50 mm.

In some embodiments, the LER has a length in a range of 200 to 900 mm. In some embodiments, the LER has a cylindrical cross section having an inner diameter in a range of 3 to 40 mm.

In some embodiments, the inner diameter of the LMFR is greater than the inner diameter of the LER. In some embodiments, the first end of the LER is within the first internal cavity of the LMFR.

In some embodiments, the top case assembly includes the casing box, three or more ultrasonic sensors, a camera module, an LED light, a charge module, a GPS module, a vibration motor, a Bluetooth module, a memory module, and a microcontroller containing an SOS system.

In some embodiments, the three or more ultrasonic sensors, the camera module, the LED light, the charge module, the GPS module, the vibration motor, the Bluetooth module, and the memory module are respectively, operably coupled to the microcontroller.

In some embodiments, the charge module, the GPS module, the vibration motor, the Bluetooth module, the memory module, and the microcontroller are enclosed in the casing box.

In some embodiments, the three or more ultrasonic sensors are configured to receive a first signal regarding obstacles detected on a walking surface. In some embodiments, the microcontroller generates a second signal responsive to the first signal.

In some embodiments, the vibration motor generates a vibration responsive to the second signal from the microcontroller. In some embodiments, the vibration indicates that obstacles are within a distance from the individual.

In some embodiments, the GPS module is configured to generate a location of the smart cane and a current time. In some embodiments, the microcontroller is configured to generate a location and time message to the Bluetooth module.

In some embodiments, the camera module is configured to capture an image of an environment around the smart cane. In some embodiments, the memory module is configured to store the image. In some embodiments, the microcontroller is configured to analyze the image to determine whether obstacles are within a distance.

In some embodiments, the charge module is a rechargeable battery capable of providing necessary driving power for an operation of the smart cane. In some embodiments, the rechargeable battery is capable of being charged by a wireless or wired charging module.

In some embodiments, the casing box includes a top side, a bottom side, the two longest sides, two shortest sides, and two intermediate sides. In some embodiments, the pivot is disposed on an outer surface of the bottom surface of the casing box. In some embodiments, the hand grip is disposed on an outer surface of a first shortest side of the casing box.

In some embodiments, at least one of the three or more ultrasonic sensors is disposed on an outer surface of the top side of the casing box.

In some embodiments, a port connected to the charge module for wired charging is in a first longest side of the casing box.

In some embodiments, at least two of the three or more ultrasonic sensors are respectively disposed on two intermediate sides of the casing box.

In some embodiments, the camera module and the LED light are disposed spaced apart from each other on an outer surface of a second shortest side of the casing box.

In some embodiments, the hand grip includes a first button responsive to a first operation mode, a second button responsive to a second operation mode, and an SOS button responsive to an SOS operation mode. In some embodiments, the first operation mode is to detect obstacles within a distance, classify the obstacles, and generate a first alert. In some embodiments, the second operation mode is to turn on the camera module, describe the environment around the individual, and generate a second alert. In some embodiments, the SOS operation mode is to connect the GPS module to internet and initiate an SOS message.

In some embodiments, the smart cane is at least made of ASTM B209 aluminum alloy 3003, ASTM D2000 rubber, and ABS plastic 3903000.

In another exemplary embodiment, a method using the smart cane is described. The smart cane includes actuating a button to select one operation mode from three operation modes of the smart cane and walking while holding a hand grip of the smart cane. In some embodiments, a load-bearing feet of the smart cane is supported by a ground surface.

The foregoing general description of the illustrative present disclosure and the following detailed description thereof are merely exemplary aspects of the teachings of this disclosure and are not restrictive.

BRIEF DESCRIPTION OF THE DRAWINGS

A more complete appreciation of this disclosure and many of the attendant advantages thereof may be readily obtained as the same becomes better understood by reference to the following detailed description when considered in connection with the accompanying drawings, wherein.

DETAILED DESCRIPTION

Figure 1:
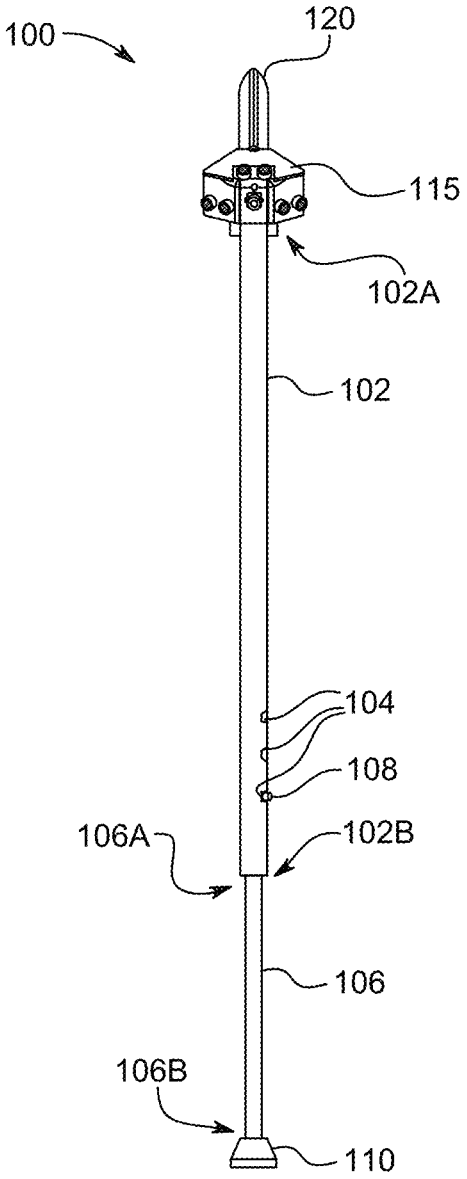
FIG. 1 is a schematic diagram depicting a smart cane for blind and/or visually impaired individual, according to certain embodiments.

In the drawings, like reference numerals designate identical or corresponding parts throughout the several views. Further, as used herein, the words "a," "an" and the like generally carry a meaning of "one or more," unless stated otherwise.

As used herein, the words "about," "approximately," or "substantially similar" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), +/−15% of the stated value (or range of values), or +/−20% of the stated value (or range of values). Within the description of this disclosure, where a numerical limit or range is stated, the endpoints are included unless stated otherwise. Also, all values and subranges within a numerical limit or range are specifically included as if explicitly written out.

The use of the terms "include," "includes", "including," "have," "has," or "having" should be generally understood as open-ended and non-limiting unless specifically stated otherwise.

Aspects of the present disclosure are directed towards a smart cane for visually impaired and/or blind. The smart cane includes extendable structural members in conjunction with a plurality of sensors and modules in order to provide dynamic, adaptive, and real-time assistance to the visually impaired. The modules may include a Bluetooth receiver and transmitter to enable Bluetooth connectivity for voice instructions and the sensors may include proximity and ultrasonic sensors to provide real-time obstacle detection to the cane. The smart cane may also include a microcontroller in order to enable a plurality of smart features in conjunction with an artificial intelligence unit. The smart cane may enhance the quality of life for the visually impaired by allowing the visually impaired to navigate their surroundings independently, safely, and with a certain level of safety.

Referring to FIG. 1, a schematic diagram of a smart cane 100 for an individual, including blind and/or visually impaired, is illustrated, according to certain embodiments. The smart cane 100 is an assistance device to provide adaptive, dynamic, and real-time walking assistance to blind and/or visually impaired individual. The smart cane 100 includes a linear main frame rod (LMFR) 102 having a first end 102A, a second end 102B and a first internal cavity. The LMFR 102 is a structural member of the smart cane 100 for providing rigidity and strength to a structure of the smart cane 100. The LMFR 102 is configured to be a hollow cylindrical shape rod to define the first internal cavity therein. In some embodiments, the LMFR 102 has a length in a range of 400 millimeters (mm) to 1600 mm, preferably 600 to 1400 mm, preferably 800 to 1200 mm, or even more preferably about 1000 mm. Other ranges are also possible. In an embodiment of the present disclosure, the LMFR 102 may have the length of about 820 mm. The length of the LMFR 102 may be defined between the first end 102A and the second end 102B thereof. As mentioned above, the LMFR 102 has a cylindrical cross section having an inner diameter in a range of 5 mm to 50 mm, preferably 10 to 45 mm, preferably 15 to 40 mm, preferably 20 to 35 mm, or even more preferably 25 to 30 mm. Other ranges are also possible. In an embodiment of the present disclosure, the inner diameter of the LMFR 102 is about 25 mm. In some embodiments, the LMFR 102 is configured to have a plurality of holes 104 equally spaced apart at a pre-determined distance. The plurality of holes 104 acts as slotting steps in order to adjust a length of the smart cane 100 as per the requirements of the individual. In some embodiments, the LMFR 102 may be made using material such as, but are not limited to, ASTM B209 aluminum alloy 3003, ASTM D2000 rubber, ABS plastic 3903000.

The smart cane 100 further includes a linear extending rod (LER) 106 having a first end 106A, a second end 106B, and a second internal cavity. The LER 106 is another structural member of the smart cane 100 providing structural rigidity and stability to the smart cane 100. The LER 106 is configured to be inserted into the first internal cavity of the LMFR 102. As such, the second end 102B of the LMFR 102 is slidably connected to the first end 106A of the LER 106. In some embodiments, the LER 106 has a length in a range of 200 mm to 900 mm, preferably 300 to 800 mm, preferably 400 to 700 mm, preferably 500 to 600 mm, or even more preferably about 550 mm. Other ranges are also possible. In some embodiments, the LER 106 has a cylindrical cross section having an inner diameter in a range of 3 mm to 40 mm, preferably 5 to 35 mm, preferably 10 to 30 mm, preferably 15 to 25 mm, or even more preferably about 20 mm. Other ranges are also possible. In some embodiments, the length of the LER 106 may be defined between the first end 106A and the second end 106B thereof. In an embodiment of the present disclosure, the LER 106 may have the length of 450 mm and the inner diameter of the LER 106 may be about 22 mm. Other ranges are also possible. In some embodiments, the LER 106 may be made using material such as, but are not limited to, ASTM B209 aluminum alloy 3003, ASTM D2000 rubber, ABS plastic 3903000.

As described above, the inner diameter of the LMFR 102 is greater than the inner diameter of the LER 106, thus the first end 106A of the LER 106 is slidably disposed within the first internal cavity of the LMFR 102. In other words, the LER 106 is configured to be inserted into the LMFR 102 in order to provide height adjustment capabilities to the smart cane 100. Further, the LER 106 includes a cylindrical protrusion 108, retractable and deployable in order to adjust the length of the smart cane 100. The cylindrical protrusion 108 is configured to be locked into place at one of the plurality of holes 104 present in the LMFR 102. In an embodiment, the plurality of holes 104 and the cylindrical protrusion 108 enables the individual to adjust the length of the smart cane 100 as desired for ergonomic enhancements. Further, the LMFR 102 and the LER 106 are made of similar materials. In some embodiments, the smart cane 100 is at least made of ASTM B209 aluminum alloy 3003, ASTM D2000 rubber, and ABS plastic 3903000. In some embodiments, the smart cane 100 may be made using a combination of the aforementioned materials. In some embodiments, the smart cane 100 is configured to be rust and deformation resistant.

Further, as can be seen from FIG. 1, the smart cane 100 includes a load-bearing feet 110 disposed at the second end 106B of the LER 106. In an aspect, the load-bearing feet 110 is a cushioning component employed to bear a load of the smart cane 100 in conjunction with a load as exerted by the individual using the smart cane 100. The load-bearing feet 110 may be manufactured using a rubber, an ABS plastic, an alloy, or a combination thereof. The smart cane 100 includes a top case assembly 115 having a pivot at a connection to the first end 102A of the LMFR 102 and a hand grip 120 operably coupled to an outer circumferential side of the top case assembly 115.

In an embodiment, an exemplary modelling analysis of the smart cane 100 is carried out to assess and determine structural rigidity of the smart cane 100 including the LMFR 102 and the LER 106, under load conditions. The modelling analysis included a plurality of parameters such as bending analysis, static analysis, fatigue analysis, and buckling load analysis. The smart cane 100 including the LMFR 102 having the length of 820 mm and the LER 106 having the length of 450 mm is used for the modelling analysis. Further, the inner diameters of the LMFR 102 and the LER 106 remained constant at, e.g., preferably about 25 mm and preferably about 22 mm, respectively. The modelling analysis and equations involved are provided below.

Bending Analysis:

Assume ⅒+n of body load applied at top end, $$F = \text{mg} = 10 \times 9.81$$

$$F = 9.81 \text{ N}$$

$$\text{Distance} = L = \frac{\text{Speed of Sound} \times \text{time}}{2}$$

$$\text{Speed of sound} = 340 \ \frac{\text{m}}{\text{s}}$$

$$\text{Speed of Sound} = \frac{340 \times 100 \text{ (cm)}}{10^6 \ (\mu\text{s})} = 0.034 \text{ cm}/\mu s$$

$$\text{Time} = 38 \text{ ms} = 38 \times 10^3 \ \mu$$

-continued $$\text{Distance} = L = \frac{0.034 \times 38 \times 10^3}{2} = 646 \text{ cm} = 0.646 \text{ m}$$

$$\text{Distance} = L = 0.65 \text{ m}$$

$$\text{Total length of rod} = 820 + 450 \text{ mm} = 1270 \text{ mm}$$

$$\text{Total length of rod} = 1.27 \text{ m}$$

$$\text{Moment of free end} = 1.27 \times 9.81$$

$$\text{Moment of free end} = 124.6 \text{ N} \cdot \text{m}$$

$$\text{Shear force V} = 98.1 \text{ N}$$

Static Analysis:

$$D = 25 \text{ mm}, d = 22 \text{ mm}$$

$$\frac{D}{d} = \frac{25}{22} = 1.136$$

Wherein D is the inner diameter of the LMFR 102 and d is the inner diameter of the LER 106. Assuming, $$\frac{r}{d} = 0.1$$

Using SCF chart for moment $$k_t = 1.6$$

$$\text{Bending stress } \sigma_B = \frac{K_t \times m \times c}{I} = \frac{32 k_t m}{\pi d^3}$$

where, m=441.45 Nm, d=22 mm $$\text{Bending stress } \sigma_B = \frac{32 \times 1.6 \times 44.145 \times 1000}{\pi \times 22^3} = 67.56 MPa$$

$$\text{Bending stress } \sigma_B = 68 MPa$$

Yield stress of Aluminium (Al 3003) used in manufacturing the LMFR 102 and the LER 106=186 MPa
UTS of Al 3003=200 Mpa $$\text{Factor of safety } FS = \frac{S_y}{\sigma_B}$$

$$\text{Factor of safety } FS = \frac{186}{68}$$

$$\text{Factor of safety } FS = 2.74$$

Fatigue Analysis:

$$S_{ut} = 200 \text{ MPa}$$

Assuming endurance limit is 0.35 Su for Al 3003

$$S_e = 0.35 \times 200$$

$$S_e = 70 MPa$$

-continued $$m_a = m_m = \frac{\eta_{max}}{2} = \frac{44.145}{2} = 22072 \text{ Nm}$$

$$k_f = 1 + q(k_t - 1)$$

$$q = 0.7$$

$$k_f = 1 + 0.7 \times (1.6 - 1)$$

$$k_f = 1.42$$

$$\sigma_m = \alpha_a = \frac{32 k_f m_m}{\pi d^3} = \frac{32 \times 1.42 \times 22072}{\pi 22^3}$$

$$\sigma_m = \sigma_a = 30MPa$$

Fatigue failure of safety using Goodman equation $$\frac{1}{N} = \frac{\sigma_a}{S_e} + \frac{\sigma_m}{S_{ut}}$$

$$\frac{1}{N} = \frac{30}{70} + \frac{30}{200}$$

$$N = 1.73$$

Buckling Analysis:
Minimum buckling critical load.

$$P_{cr} = \frac{\pi^2 EI}{L^2}$$

Maximum buckling critical load.

$$d = 22 \text{ mm}$$

$$I = \frac{\pi d^4}{64} = \frac{\pi \times 22^4}{64} = 11.5 \times 10^3 \text{ mm}^4$$

$$L = 1270 \text{ mm}$$

For Aluminum E=700 Pa $$P_{cr} = \frac{\pi^2 \times 70000 \times 11.5 \times 10^3}{1270^2}$$

$$P_{cr} = 4925.5N$$

$$F_{max} = 981N$$

Factor of safety against buckling, $$N = \frac{P_{cr}}{F_{max}}$$

$$N = \frac{4925.5}{981} = 5.02 > 1$$

In light of the aforementioned modelling analysis, the smart cane 100 is found to be structurally rigid and safe for personal use.

Figure 2A:
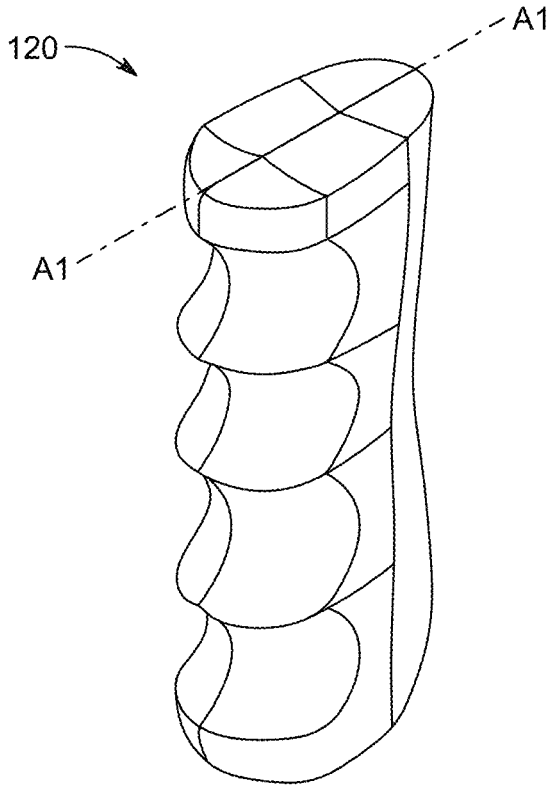
FIG. 2A is a schematic diagram depicting an enlarged view of a hand grip included in the smart cane, according to certain embodiments.

Referring to FIG. 2A, a schematic diagram depicting an enlarged view of the hand grip 120 is illustrated, according to certain embodiments. As can be seen from FIG. 2A, the hand grip 120 is configured to have a plurality of indents for one or more fingers of the individual, as such, the plurality of indents comfortably houses the one or more fingers of the individual. The hand grip 120 has an axis of symmetry 'A1', configured to figuratively divide the hand grip 120 into two equal sections. In some embodiments, the hand grip 120 is made using a wear resistant foam, an ABS plastic, a memory foam, or a combination thereof. The hand grip 120 further includes a weather proof coating to prevent exposure to multiple environmental factors, such as, but are not limited to, moisture, water, and hand grease.

Figure 2B:
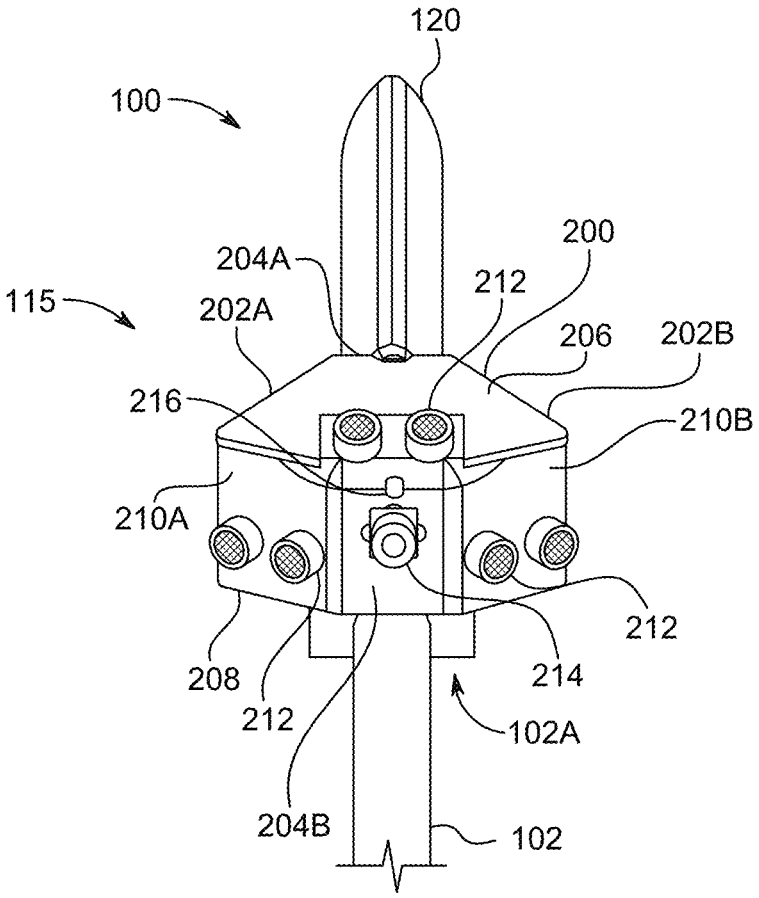
FIG. 2B is a schematic diagram of the smart cane showing a top case assembly thereof, according to certain embodiments.

Referring to FIG. 2B, an enlarged schematic diagram of the top case assembly 115 attached with the hand grip 120 and the LMFR 102 is illustrated, respectively, according to certain embodiments. As can be seen from FIG. 2B, the hand grip 120 is operably coupled to the LMFR via the top case assembly 115 as such, the hand grip 120 and the top case assembly 115 are movable relative to the LMFR 102. In other words, the individual may adjust the hand grip 120 at a suitable angle, and the pivot joint enables the hand grip 120 to be adjusted as per user requirements. In some embodiments, the top case assembly 115 includes a casing box 200. In particular, the casing box 200 is a weather resistant and wear resistant casing configured to enclose a plurality of components included in the top case assembly 115. In some embodiments, the casing box 200 of the top case assembly 115 is in the form of an irregular hexagonal cell having an axis of symmetry 'A2' (shown in FIG. 2C). The axis of symmetry 'A2' is coaxial with the axis of symmetry 'A1' of the hand grip 120. As such, the hand grip 120 and the casing box 200 are configured to align with each other longitudinally. The irregular hexagonal cell shape of the casing box 200 signifies that the casing box 200 has at least two longest sides 202A, 202B and at least two shortest sides 204A, 204B. In some embodiments, the two longest sides 202A, 202B of the irregular hexagonal cell are opposite one another. Further, the two longest sides 202A, 202B extend lengthwise down the axis 'A1' of the hand grip 120 sloping away from the axis 'A1' of the hand grip 120. In other words, the casing box 200 is narrower proximal to the hand grip 120 and wider proximal to the first end 102A of the LMFR 102. Furthermore, the two shortest sides 204A, 204B of the irregular hexagonal cell are of equal length and are opposite one another. In some embodiments, one of the two shortest sides 204A, 204B of the irregular hexagonal cell is proximal to the hand grip 120. In other words, a first shortest side 204A of the two shortest sides 204A, 204B is proximal to the hand grip 120. In addition, the other of the two shortest sides 204A, 204B is proximal to the first end 102A of the LMFR 102. In other words, a second shortest side 204B of the two shortest sides 204A, 204B is proximal to the first end 102A of the LMFR 102. In some embodiments, the two shortest sides 204A, 204B of the irregular hexagonal cell are perpendicular to the axis 'Al' of the hand grip 120. In addition, the casing box 200 includes a top side 206, a bottom side 208, the two longest sides 202A, 202B, the two shortest sides 204A, 204B, and two intermediate sides 210A, 210B. The pivot (as described in FIG. 1) is disposed on an outer surface of the bottom side 208 of the casing box 200. Furthermore, the hand grip 120 is disposed on an outer surface of the first shortest side 204A of the casing box 200.

Figure 2C:
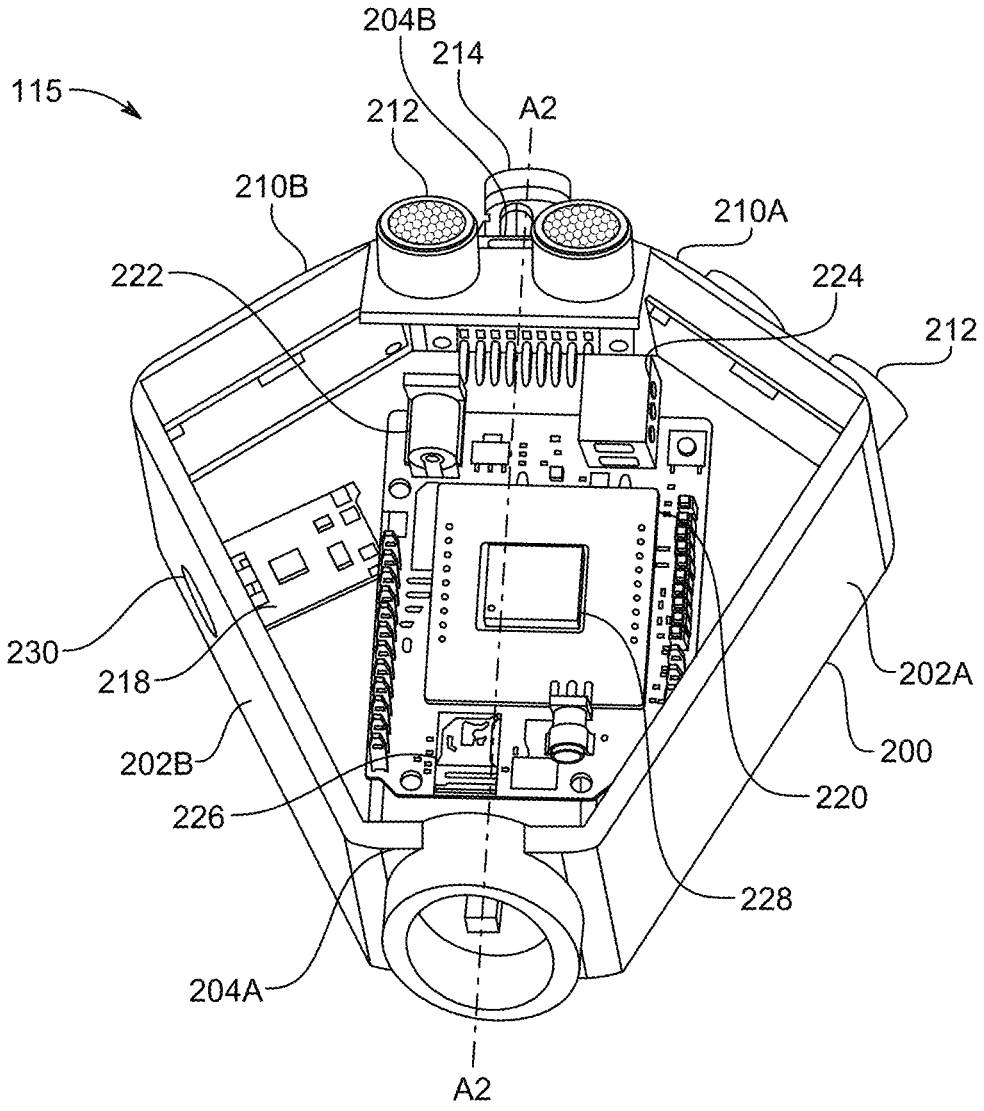
FIG. 2C is a schematic diagram depicting an enlarged view of the top case assembly without the top side, according to certain embodiments.

Referring to FIG. 2C, a schematic diagram of the top case assembly 115 without the top side 206 is illustrated, according to certain embodiments. As can be seen from FIG. 2B and FIG. 2C, the top case assembly 115 includes three or more ultrasonic sensors 212, a camera module 214, an LED light 216, a charge module 218, a GPS module 220, a vibration motor 222, a Bluetooth module 224, a memory module 226, and a microcontroller 228 containing an SOS system. In some embodiments, the top case assembly 115 includes, e,g., preferably 3 to 12 ultrasonic sensors 212, preferably 4 to 10 ultrasonic sensors, preferably 6 to 8 ultrasonic sensors, or even more preferably 6 ultrasonic sensors. Other ranges are also possible. In some embodiments, at least one of the three or more ultrasonic sensors 212 is disposed on an outer surface of the top side 206 of the casing box 200. Further, at least two of the three or more ultrasonic sensors 212 are disposed on the two intermediate sides 210A, 210B of the casing box 200. In addition, a port 230 connected to the charge module 218 for wired charging is defined in a second longest side 202B of the casing box 200. In other words, the charge module 218 is powered using alternating or direct current via the port 230 in order to provide appropriate power for optimal functioning of the smart cane 100. Furthermore, the camera module 214 and the LED light 216 are disposed, and spaced apart from each other, on an outer surface of the second shortest side 204B of the casing box 200. In some embodiments, the LED light 216 is configured to light up a vicinity of the smart cane 100 in order to improve images captured by the camera module 214.

In some embodiments, the charge module 218, the GPS module 220, the vibration motor 222, the Bluetooth module 224, the memory module 226, and the microcontroller 228 are enclosed in the casing box 200. Further, the three or more ultrasonic sensors 212, the camera module 214, the LED light 216, the charge module 218, the GPS module 220, the vibration motor 222, and the Bluetooth module 224, and the memory module 226 are respectively, and operably coupled to the microcontroller 228. In other words, the microcontroller 228 is configured to govern multiple operations performed by the above mentioned components. In some embodiments, the smart cane 100 senses multiple obstacles present in front of the smart cane 100 via the three or more ultrasonic sensors 212. In general, ultrasonic sensors are electronic devices that calculate a distance of a target or an obstacle by emission of ultrasonic sound waves and further converting the ultrasonic waves into electrical signals. Ultrasonic sensors, in general, includes two essential elements, a transmitter and a receiver. Using piezoelectric crystals, the transmitter generates ultrasonic waves, and from there the ultrasonic waves travel to the target or the obstacle and gets back to the receiver. In some embodiments, the three or more ultrasonic sensors 212 are configured to receive a first signal regarding obstacles detected on a walking surface, and the microcontroller 228 generates a second signal responsive to the first signal and subsequently alert the individual regarding a presence of the obstacle.

In some embodiments, the camera module 214 is configured to capture the image of an environment around the smart cane 100 and the memory module 226 is configured to store the images as captured by the camera module 214. In addition, the microcontroller 228 is configured to analyze the image to determine whether obstacles are within a distance or the vicinity of the smart cane 100. In other words, the camera module 214 is configured to scan an area in front of the smart cane 100 via a lens included in the camera module 214 and transmit imagery to the microcontroller 228 for analysis of the distance of the obstacle from the smart cane 100. In some embodiments, the charge module 218 is a rechargeable battery capable of providing necessary driving power for an operation of the smart cane 100. In order to improve usability of the smart cane 100, the rechargeable battery is capable of being charged by a wireless or wired charging module. In some embodiments, the vibration motor 222 generates a vibration responsive to the second signal from the microcontroller 228, and the vibration indicates that the obstacles are within a distance from the individual. In other words, the vibration produced by the vibration motor 222, in response to the detection of the obstacle within the vicinity of the smart cane 100, acts as a haptic feedback for the individual. Consequently, the individual is alerted regarding the presence of the obstacle so the individual may maneuver around the obstacle. Moreover, the GPS module 220 is configured to generate a location of the smart cane 100 and a current time. In general, GPS refers to global positioning system responsible for generating or detecting a location of a particular object. The GPS module 220 enables the smart cane 100 to have real-time positioning capabilities. In particular, a caretaker or an acquaintance of the individual using the smart cane 100 may have a real-time location of the individual, resulting in an overall safer environment for the individual. The real-time location, as provided by the GPS module 220 may be transmitted to the individual in order for the individual to know the location they are currently traversing. In some embodiments, the microcontroller 228 is configured to generate a location and time message and transmit it to the Bluetooth module 224. The Bluetooth module 224 enables a connection of the smart cane 100 to a mobile device or a smartphone, present with the individual using the smart cane 100. In general, GPS is an accurate way of measuring time, as it may automatically judge multiple time zones. The location message and time message, as generated by the GPS module 220, are transmitted to the Bluetooth module 224, subsequently relayed to the individual. In some embodiments, in case of an emergency, the location and time message may also be relayed to multiple emergency contacts of the individual using the smart cane 100. In some embodiments, the location and time message may also be relayed to one or more emergency services such as, but not limited to, law enforcement department, emergency medical services, and fire department.

Figure 2D:
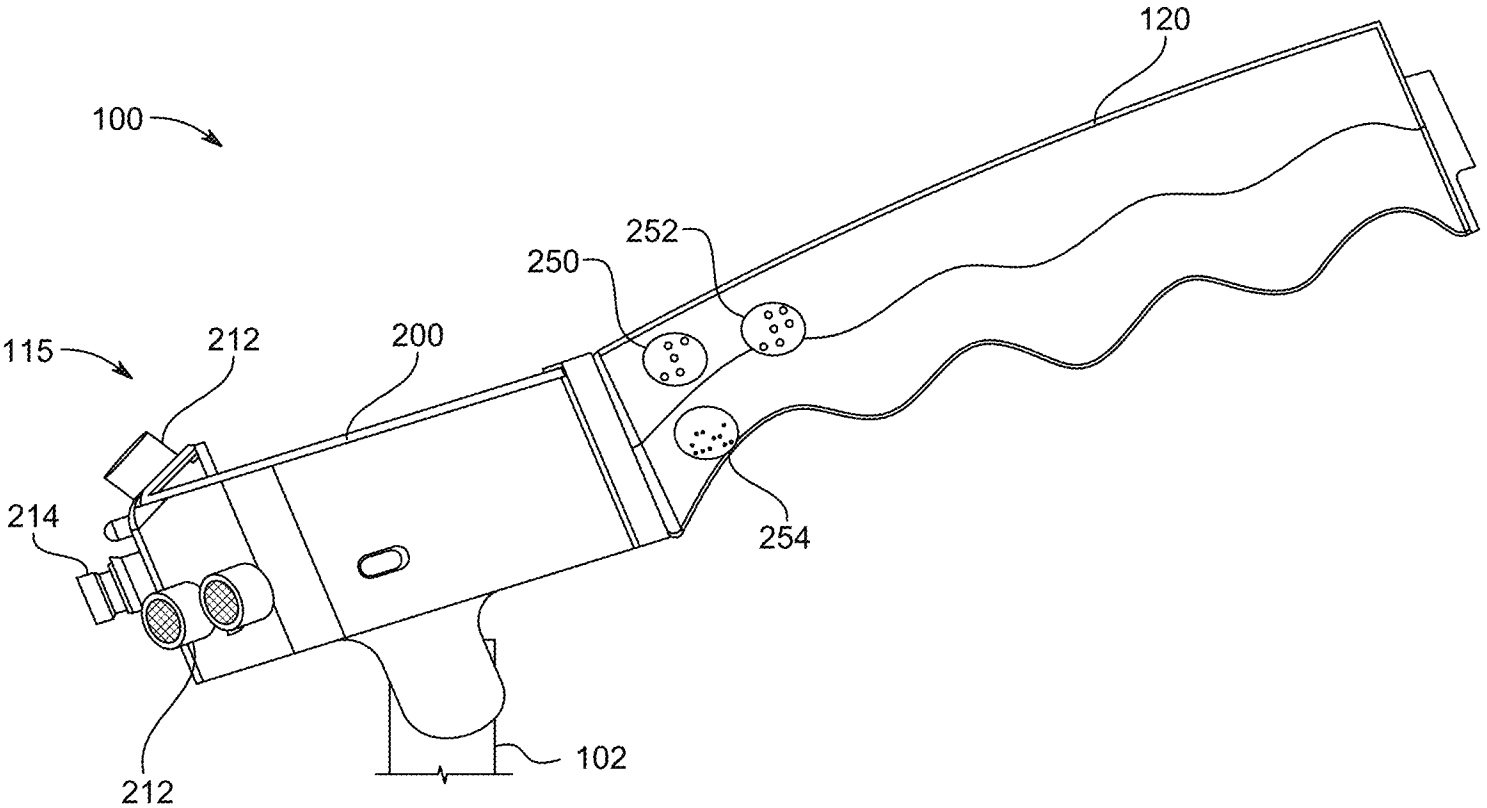
FIG. 2D is a schematic side view of a portion of the smart cane showing the hand grip and the top case assembly, according to certain embodiments.

Referring to FIG. 2D, a schematic side view of the top case assembly 115 and the hand grip 120 is illustrated, according to certain embodiments. In particular, FIG. 2D depicts a plurality of mode buttons included in the smart cane 100. In an embodiment of the present disclosure, the hand grip 120 includes a first button 250 for a first operation mode, a second button 252 responsive to a second operation mode, and an SOS button 254 responsive to an SOS operation mode. In an embodiment, the first button 250, the second button 252, and the SOS button 254 are configured on a left side of the hand grip 120. In an embodiment of the present disclosure, the first button 250, the second button 252, and the SOS button 254 may be configured on a right side of the hand grip 120 in order to make the smart cane 100 ergonomic for a left handed individual. Further, the first operation mode is to detect obstacles within a distance, classify the obstacles, and generate a first alert. In other words, the first operation mode, as activated by the first button 250, is configured to detect and classify the obstacles present in the vicinity of the smart cane 100. The first button 250 transmits a command to the microcontroller 228, and in response, the microcontroller 228 activates the first operation mode. Furthermore, classification of the obstacles refers to determination of size and type of the obstacles present in the vicinity of the smart cane 100. In response to successful detection and classification of obstacles, the smart cane 100 alerts the individual via activating the vibration motor 222generating the first alert. In addition, if there are no obstacles detected or classified by the smart cane 100, first alert generation process is skipped, and the individual may walk without being alarmed. In some embodiments, the second operation mode is to turn on the camera module 214, describe the environment around the individual, and generate a second alert. In other words, the second operation mode, as activated by the second button 252, informs the individual using the smart cane 100 about the environment around the vicinity of the smart cane 100. The camera module 214 scans the environment around the smart cane 100 and relay captured information to the microcontroller 228, which in turn gets relayed to the individual using the smart cane 100. The information captured by the camera module 214 may be accessed by pressing the second button 252. The SOS operation mode is to connect the GPS module 220 to internet and initiate an SOS message. In general, SOS message refers to any emergency message initiated to alert concerned authorities to provide assistance to a particular individual who initiated the SOS message. In particular, during the SOS operation mode, as activated by the SOS button 254, the microcontroller 228 and the GPS module 220 of the smart cane 100 may produce an emergency signal including the real-time location coordinates of the smart cane 100 and transmit the signal to the concerned authorities.

Figure 3:
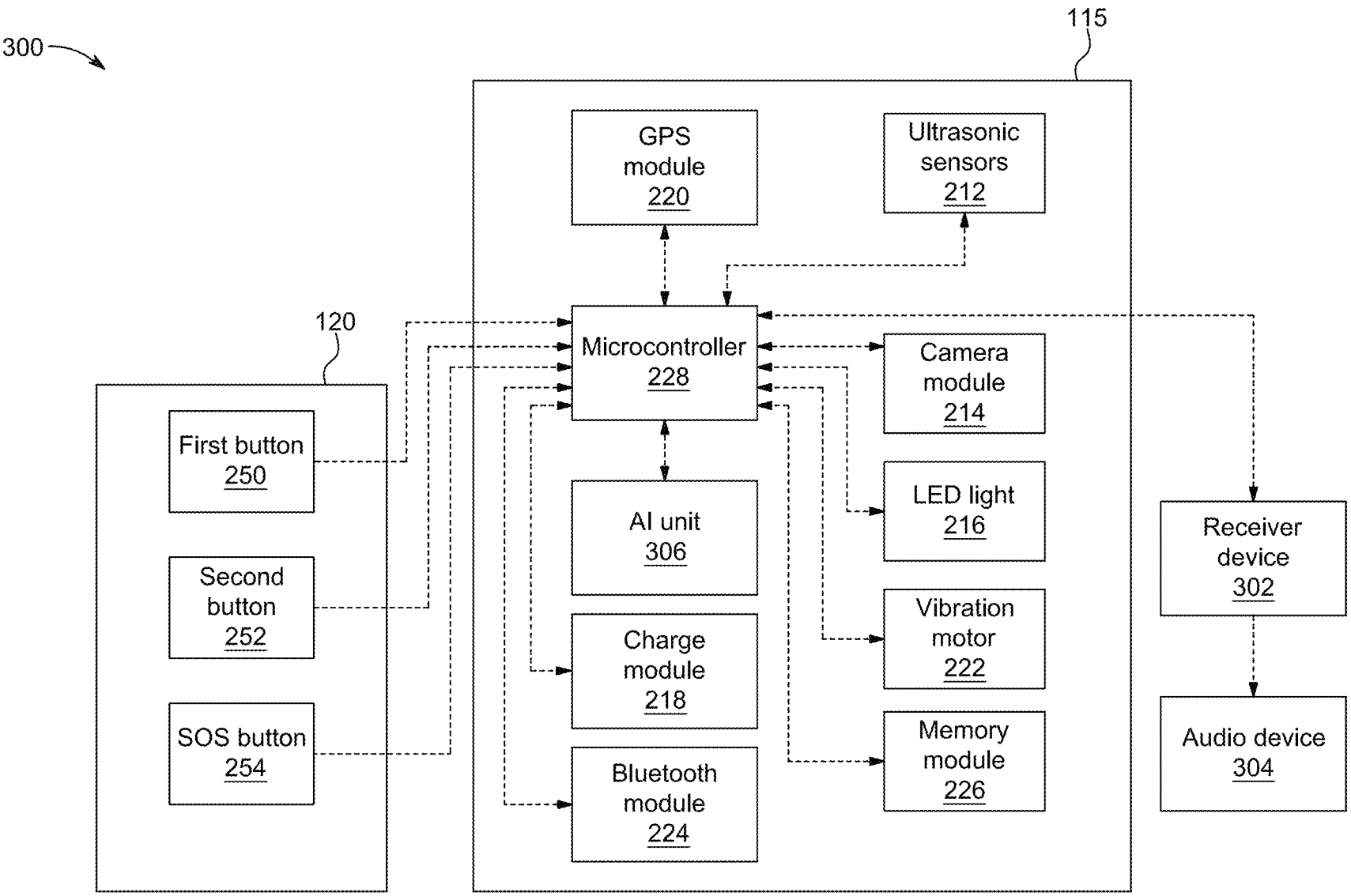
FIG. 3 is a schematic block diagram of a system depicting a sequence of operations of the smart cane, according to certain embodiments.

Referring to FIG. 3, a schematic block diagram of a system 300 including the smart cane 100 and associated components is illustrated, according to certain embodiments. In particular, the system 300 describes the interaction between the aforementioned components included in the top case assembly 115 and the smart cane 100. As described in FIGS. 2C and 2D, the system 300 includes the charge module 218, the GPS module 220, the vibration motor 222, the Bluetooth module 224, the microcontroller 228, the first button 250, the second button 252, the SOS button 254, a receiver device 302, an audio device 304, and an artificial intelligence (AI) unit 306. In some embodiments, the microcontroller 228 is electrically and communicatively coupled with the charge module 218, the GPS module 220, the vibration motor 222, the Bluetooth module 224, the first button 250, the second button 252, the SOS button 254, the audio device 304, and the AI unit 306. In other words, the microcontroller 228 receives a plurality of inputs from the GPS module 220, the first button 250, the second button 252, and the SOS button 254 and produces a plurality of output signals. The plurality of output signals are transmitted to the Bluetooth module 224. The Bluetooth module 224 generates a signal in response to an input received from the microcontroller 228, and the signal produced by the Bluetooth module 224 is further transmitted to the receiver device 302. The receiver device 302 may include, but is not limited to, a smartphone, a smart tablet, and remote computing device. The receiver device 302 may be a mobile device in order to provide ease-of-use to the individual with the smart cane 100. The receiver device 302 intercepts the signal from the Bluetooth module 224 and further produces a set of data. The set of data may be transmitted to the audio device 304 in order to produce auditory stimulation for the individual. The audio device 304 may include, but is not limited to, a pair of wireless Bluetooth headphones, a pair of wired headphones, a pair of wireless earphones, a pair of wired earphones, a pair of in-ear monitors (IEM). The individual may receive audio directions, alerts, and other relevant information transmitted by the system 300 via the audio device 304. Moreover, the AI unit 306 may include a plurality of AI algorithms configured to assist the microcontroller 228 in efficient processing of information received from plurality of sensors and components. The AI unit 306 may include one or more machine learning algorithms. In some embodiments, the AI unit 306 is essential for providing individualized support to the individual using the smart cane 100. In other words, the AI unit 306 may assist the microcontroller 228 to continuously adapt to a plurality of user habits of the individual and constantly improve the individualized support provided by the smart cane 100. In addition, the AI unit 306 may enable the smart cane 100 to receive remote firmware and software upgrades and may enable the smart cane 100 to be integrated with advanced obstacle detection systems as required. The AI unit 306 further provides improved situational awareness and safety to the individual.

Figure 4:
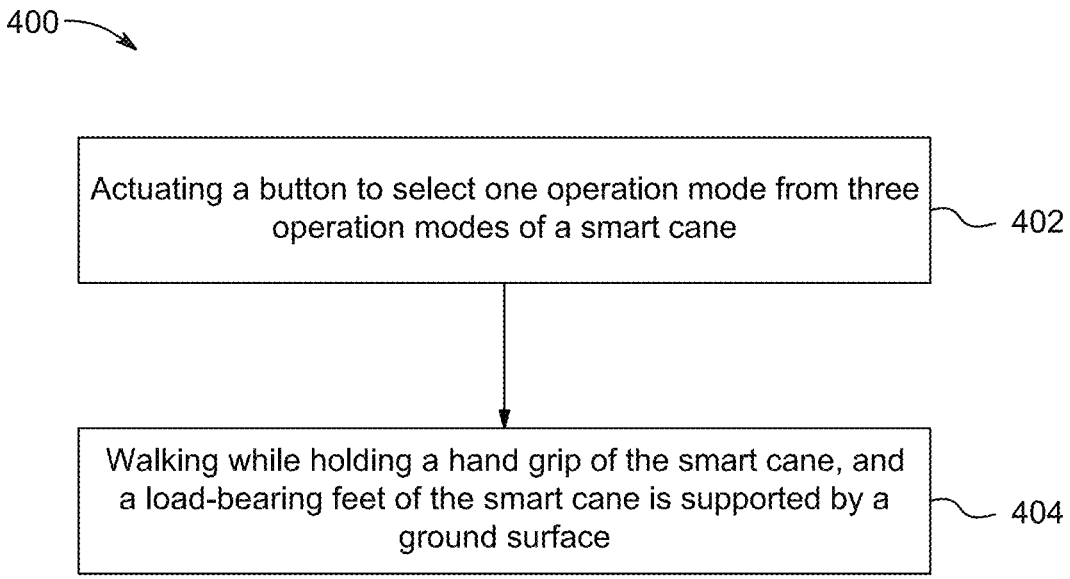
FIG. 4 is a schematic flowchart depicting a method of using the smart cane, according to certain embodiments.

Referring to FIG. 4, a flowchart depicting a method 400 of using the smart cane 100 is illustrated, according to certain embodiments. The order in which the method 400 is described is not intended to be construed as a limitation, and any number of the described method steps may be combined in any order to implement the method 400. Additionally, individual steps may be removed or skipped from the method 400 without departing from the spirit and scope of the present disclosure. At step 402, the method 400 includes actuating a button to select one operation mode from three operation modes of the smart cane 100. In particular, the button is selected from the first button 250, the second button 252, and the SOS button 254. When the first operation mode is selected from the three operation modes, the smart cane 100 may initiate a program to detect obstacles and classify them. Similarly, when the second operation is selected from the three operation modes, the smart cane 100 may initiate a program to execute camera operations and describe an environment around the individual to the individual via the audio device 304. Further, when the SOS operation mode is selected from the three operation modes, the smart cane 100 may alert multiple saved contacts of the individual in case of an emergency. Furthermore, at step 404, the method 400 includes walking while holding the hand grip 120 of the smart cane 100 and the load-bearing feet 110 of the smart cane 100 is supported by a ground surface. In other words, step 404 defines normal walking scenario of the individual with the smart cane 100.

Figure 5:
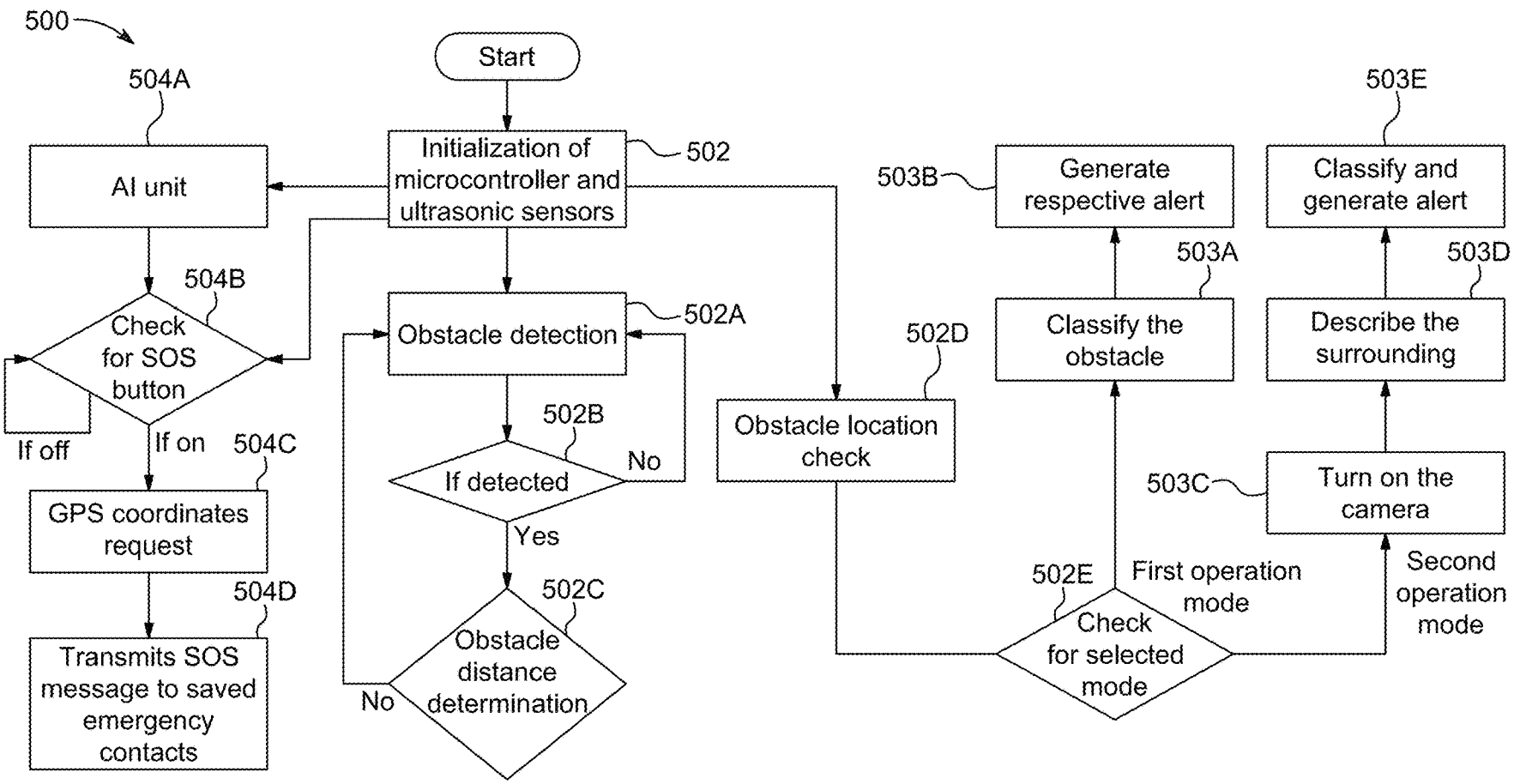
FIG. 5 is a schematic flow diagram depicting an exemplary working scenario of the smart cane, according to certain embodiments.

Referring to FIG. 5, a schematic flow diagram 500 depicting an exemplary sequence of operation for the smart cane 100 is illustrated, according to certain embodiments. The order in which the flow diagram 500 is described is not intended to be construed as a limitation, and any number of the described method steps may be combined in any order to implement the flow diagram 500. Additionally, individual steps may be removed or skipped from the flow diagram 500 without departing from the spirit and scope of the present disclosure. In an example of the present disclosure, the smart cane 100 is actuated by pressing the first button 250, the second button 252, or the SOS button 254. Referring to FIG. 2A through FIG. 5, at step 502, the microcontroller 228 and three or more ultrasonic sensors 212 are initialized. Post initialization, the smart cane 100 is configured to perform at least two simultaneous operation routes. At step 502A, the smart cane 100 performs an obstacle detection procedure. At step 502B, the smart cane 100 determines the detection of the obstacle as in whether the obstacle is present in the vicinity of the smart cane 100. At step 502C the smart cane 100 determines a distance of the obstacle from the smart cane 100 in case the obstacle is present in front of the smart cane 100. In particular, if the obstacle is at a pre-determined threshold distance from the smart cane 100, then the smart cane performs the step 502A again. However, step 502D is executed if the obstacle is in the vicinity of the smart cane 100. At step 502D, the smart cane 100 checks for a location of the obstacle. Further, at step 502E, the smart cane 100 checks for a selected mode of operation. In particular, at step 502E, at least two modes may be checked, and in which, the first operation mode of the at least two modes may be executed at step 503A and at step 503B. At step 503A, the first operation mode classifies a category of the obstacle from a plurality of predefined categories. At step 503B, the first operation mode generates a respective alert in response to the detection of the obstacle. The alert may be further relayed on to the individual via the audio device 304 as described in FIG. 3.

In addition, the second operation mode of the at least two modes may be executed at step 503C, at step 503D, and at step 503E. At step 503C, the second operation mode executes a command to turn on the camera module 214. Further, at step 503D, the camera module 214 may describe the surrounding of the smart cane 100. In conclusion, at step 503E, the second operation mode may classify the obstacle as detected by the camera module 214 and generate one or more alerts to alert the individual regarding the obstacle.

At step 504A, the microcontroller 228 of the smart cane 100 is communicated with the AI unit 306. Further, at step 504B, the smart cane 100 checks for a status of the SOS button 254, in case the SOS button 254 is switched off, the smart cane 100 executes the step 504B again. However, in case the SOS button 254 is switched on, the smart cane 100 executes step 504C. At step 504C, the smart cane 100 requests coordinates of the GPS module 220, included in the smart cane 100. Further, at step 504D, the smart cane 100 transmits the coordinates received from the GPS module 220 to of the saved emergency contacts of the individual using the smart cane 100.

Figure 6:
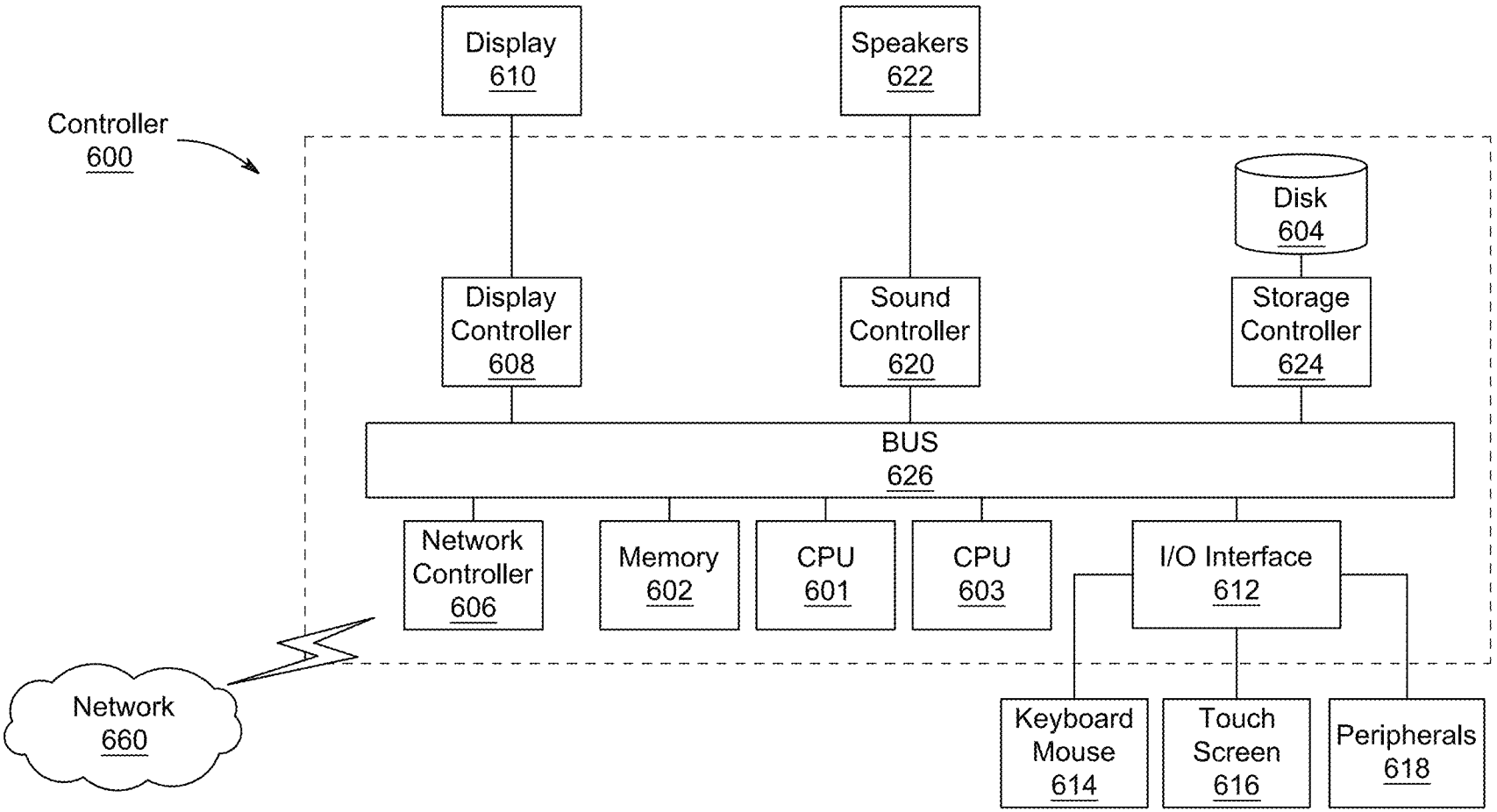
FIG. 6 is an illustration of a non-limiting example of details of a computing hardware used in the system of FIG. 3, according to certain embodiments.

Next, further details of the hardware description of the computing environment according to exemplary embodiments is described with reference to FIG. 6. In FIG. 6, a controller 600 is described is representative of the system 300 of FIG. 3 in which the controller is a computing device which includes a CPU 601 which performs the processes described above/below. The process data and instructions may be stored in memory 602. These processes and instructions may also be stored on a storage medium disk 604 such as a hard drive (HDD) or portable storage medium or may be stored remotely.

Further, the claims are not limited by the form of the computer-readable media on which the instructions of the inventive process are stored. For example, the instructions may be stored on CDs, DVDs, in FLASH memory, RAM, ROM, PROM, EPROM, EEPROM, hard disk or any other information processing device with which the computing device communicates, such as a server or computer.

Further, the claims may be provided as a utility application, background daemon, or component of an operating system, or combination thereof, executing in conjunction with CPU 601, 603 and an operating system such as Microsoft Windows 7, Microsoft Windows 10, Microsoft Windows 11, UNIX, Solaris, LINUX, Apple MAC-OS, and other systems known to those skilled in the art.

The hardware elements in order to achieve the computing device may be realized by various circuitry elements, known to those skilled in the art. For example, CPU 601 or CPU 603 may be a Xenon or Core processor from Intel of America or an Opteron processor from AMD of America, or may be other processor types that would be recognized by one of ordinary skill in the art. Alternatively, the CPU 601, 603 may be implemented on an FPGA, ASIC, PLD or using discrete logic circuits, as one of ordinary skill in the art would recognize. Further, CPU 601, 603 may be implemented as multiple processors cooperatively working in parallel to perform the instructions of the inventive processes described above.

The computing device in FIG. 6 also includes a network controller 606, such as an Intel Ethernet PRO network interface card from Intel Corporation of America, for interfacing with network 660. As can be appreciated, the network 660 can be a public network, such as the Internet, or a private network such as an LAN or WAN network, or any combination thereof and can also include PSTN or ISDN subnetworks. The network 660 can also be wired, such as an Ethernet network, or can be wireless such as a cellular network including EDGE, 3G, 4G and 5G wireless cellular systems. The wireless network can also be Wi-Fi, Bluetooth, or any other wireless form of communication that is known.

The computing device further includes a display controller 608, such as a NVIDIA GeForce GTX or Quadro graphics adaptor from NVIDIA Corporation of America for interfacing with display 610, such as a Hewlett Packard HPL2445w LCD monitor. A general purpose I/O interface 612 interfaces with a keyboard and/or mouse 614 as well as a touch screen panel 616 on or separate from display 610. General purpose I/O interface also connects to a variety of peripherals 618 including printers and scanners, such as an OfficeJet or DeskJet from Hewlett Packard.

A sound controller 620 is also provided in the computing device such as Sound Blaster X-Fi Titanium from Creative, to interface with speakers/microphone 622 thereby providing sounds and/or music.

The general purpose storage controller 624 connects the storage medium disk 604 with communication bus 626, which may be an ISA, EISA, VESA, PCI, or similar, for interconnecting all of the components of the computing device. A description of the general features and functionality of the display 610, keyboard and/or mouse 614, as well as the display controller 608, storage controller 624, network controller 606, sound controller 620, and general purpose I/O interface 612 is omitted herein for brevity as these features are known.

The exemplary circuit elements described in the context of the present disclosure may be replaced with other elements and structured differently than the examples provided herein. Moreover, circuitry configured to perform features described herein may be implemented in multiple circuit units (e.g., chips), or the features may be combined in circuitry on a single chipset, as shown in FIG. 7.

Figure 7:
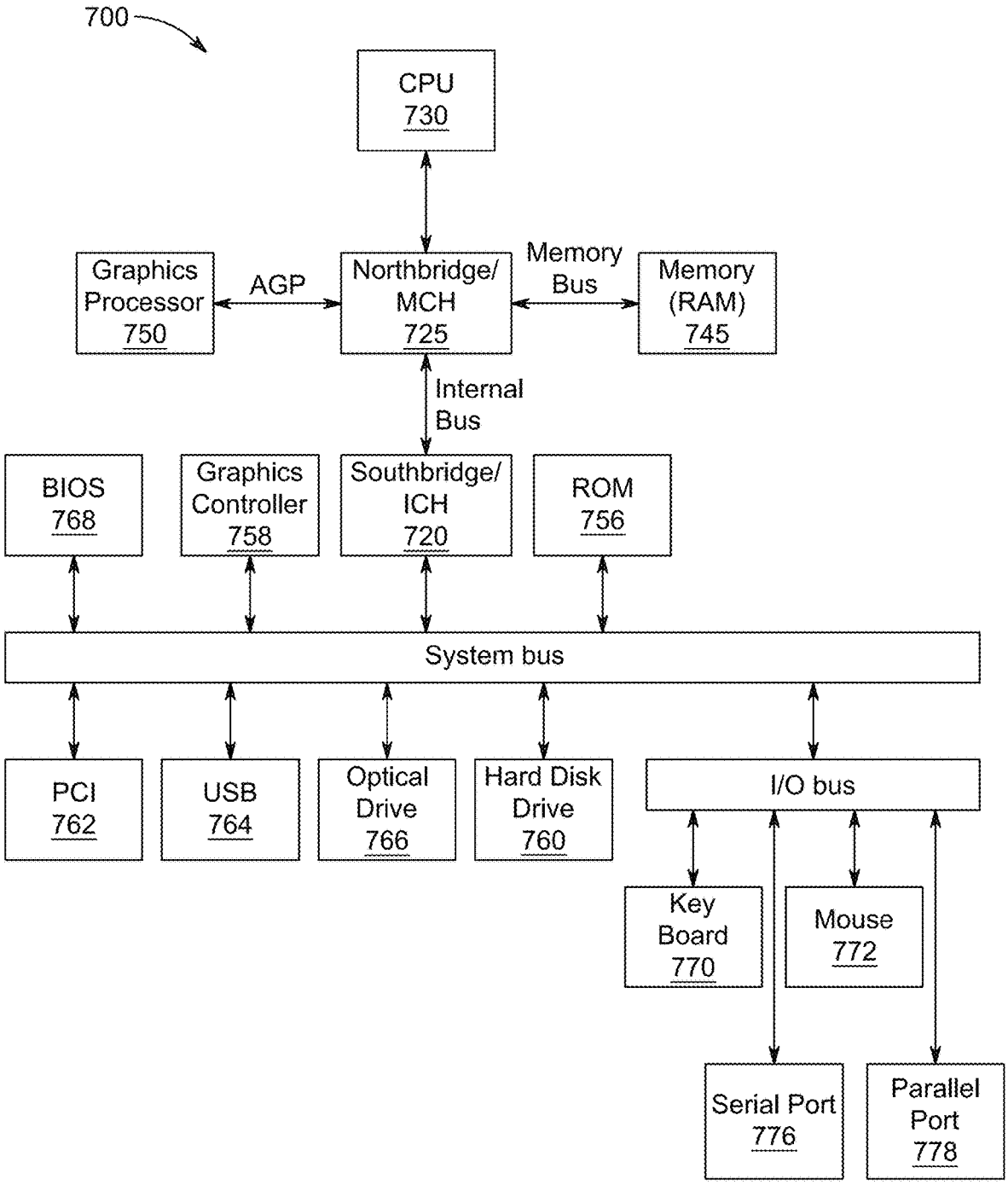
FIG. 7 is an exemplary schematic diagram of a data processing system used within the system, according to certain embodiments.

FIG. 7 shows a schematic diagram of a data processing system, according to certain embodiments, for performing the functions of the exemplary embodiments. The data processing system is an example of a computer in which code or instructions implementing the processes of the illustrative embodiments may be located.

In FIG. 7, data processing system 700 employs a hub architecture including a north bridge and memory controller hub (NB/MCH) 725 and a south bridge and input/output (I/O) controller hub (SB/ICH) 720. The central processing unit (CPU) 730 is connected to NB/MCH 725. The NB/MCH 725 also connects to the memory 745 via a memory bus and connects to the graphics processor 750 via an accelerated graphics port (AGP). The NB/MCH 725 also connects to the SB/ICH 720 via an internal bus (e.g., a unified media interface or a direct media interface). The CPU Processing unit 730 may contain one or more processors and even may be implemented using one or more heterogeneous processor systems.

Figure 8:
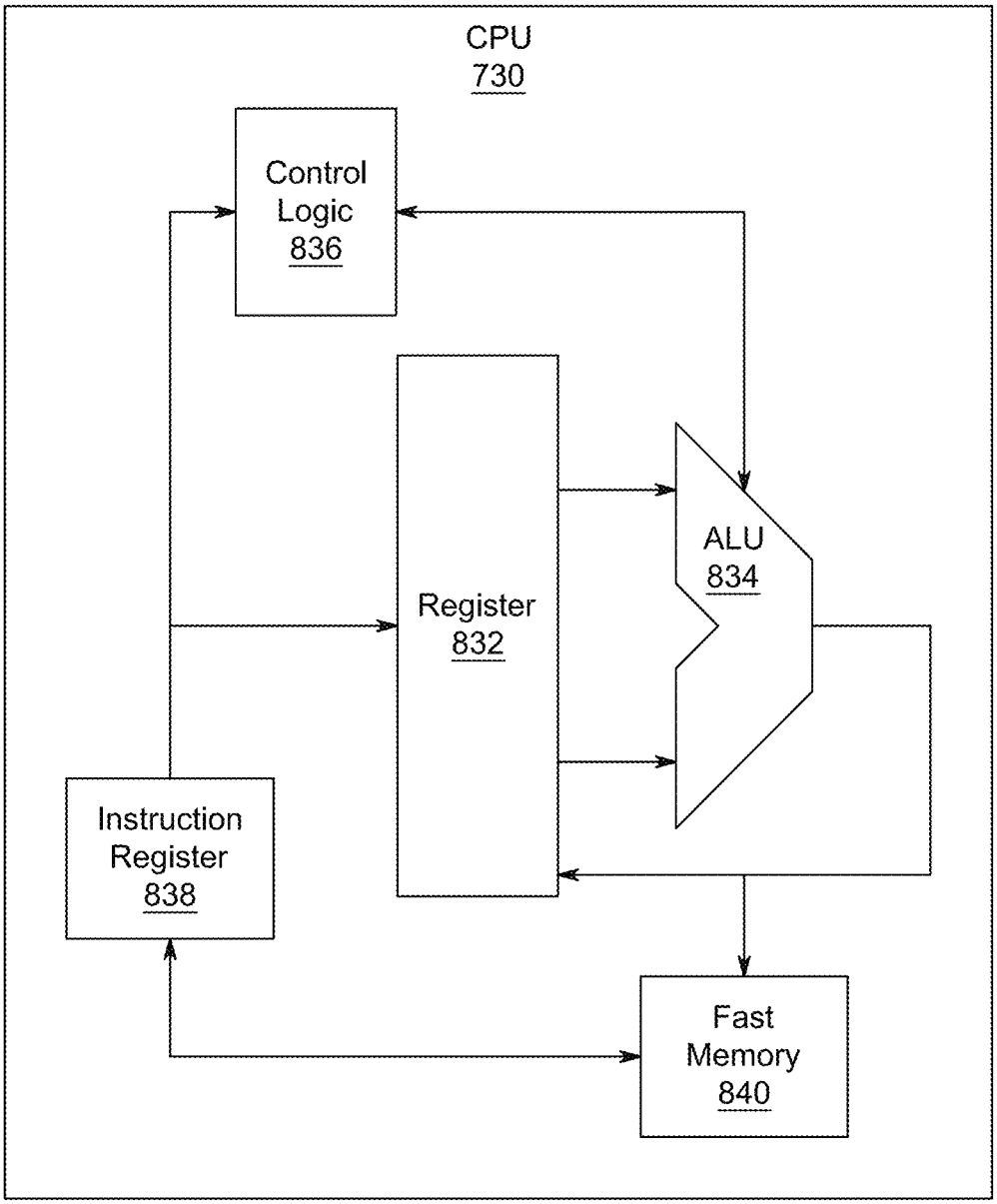
FIG. 8 is an exemplary schematic diagram of a processor used with the system, according to certain embodiments.

For example, FIG. 8 shows one implementation of CPU 730. In one implementation, the instruction register 838 retrieves instructions from the fast memory 840. At least part of these instructions are fetched from the instruction register 838 by the control logic 836 and interpreted according to the instruction set architecture of the CPU 730. Part of the instructions can also be directed to the register 832. In one implementation the instructions are decoded according to a hardwired method, and in another implementation the instructions are decoded according to a microprogram that translates instructions into sets of CPU configuration signals that are applied sequentially over multiple clock pulses. After fetching and decoding the instructions, the instructions are executed using the arithmetic logic unit (ALU) 834 that loads values from the register 832 and performs logical and mathematical operations on the loaded values according to the instructions. The results from these operations can be feedback into the register and/or stored in the fast memory 840. According to certain implementations, the instruction set architecture of the CPU 730 can use a reduced instruction set architecture, a complex instruction set architecture, a vector processor architecture, a very large instruction word architecture. Furthermore, the CPU 730 can be based on the Von Neuman model or the Harvard model. The CPU 730 can be a digital signal processor, an FPGA, an ASIC, a PLA, a PLD, or a CPLD. Further, the CPU 730 can be an x86 processor by Intel or by AMD; an ARM processor, a Power architecture processor by, e.g., IBM; a SPARC architecture processor by Sun Microsystems or by Oracle; or other known CPU architecture.

Referring again to FIG. 7, the data processing system 700 can include that the SB/ICH 720 is coupled through a system bus to an I/O Bus, a read only memory (ROM) 756, universal serial bus (USB) port 764, a flash binary input/output system (BIOS) 768, and a graphics controller 758. PCI/PCIe devices can also be coupled to SB/ICH 788 through a PCI bus 762.

The PCI devices may include, for example, Ethernet adapters, add-in cards, and PC cards for notebook computers. The Hard disk drive 760 and CD-ROM 766 can use, for example, an integrated drive electronics (IDE) or serial advanced technology attachment (SATA) interface. In one implementation the I/O bus can include a super I/O (SIO) device.

Further, the hard disk drive (HDD) 760 and optical drive 766 can also be coupled to the SB/ICH 720 through a system bus. In one implementation, a keyboard 770, a mouse 772, a parallel port 778, and a serial port 776 can be connected to the system bus through the I/O bus. Other peripherals and devices that can be connected to the SB/ICH 720 using a mass storage controller such as SATA or PATA, an Ethernet port, an ISA bus, a LPC bridge, SMBus, a DMA controller, and an Audio Codec.

Moreover, the present disclosure is not limited to the specific circuit elements described herein, nor is the present disclosure limited to the specific sizing and classification of these elements. For example, the skilled artisan will appreciate that the circuitry described herein may be adapted based on changes on battery sizing and chemistry or based on the requirements of the intended back-up load to be powered.

Figure 9:
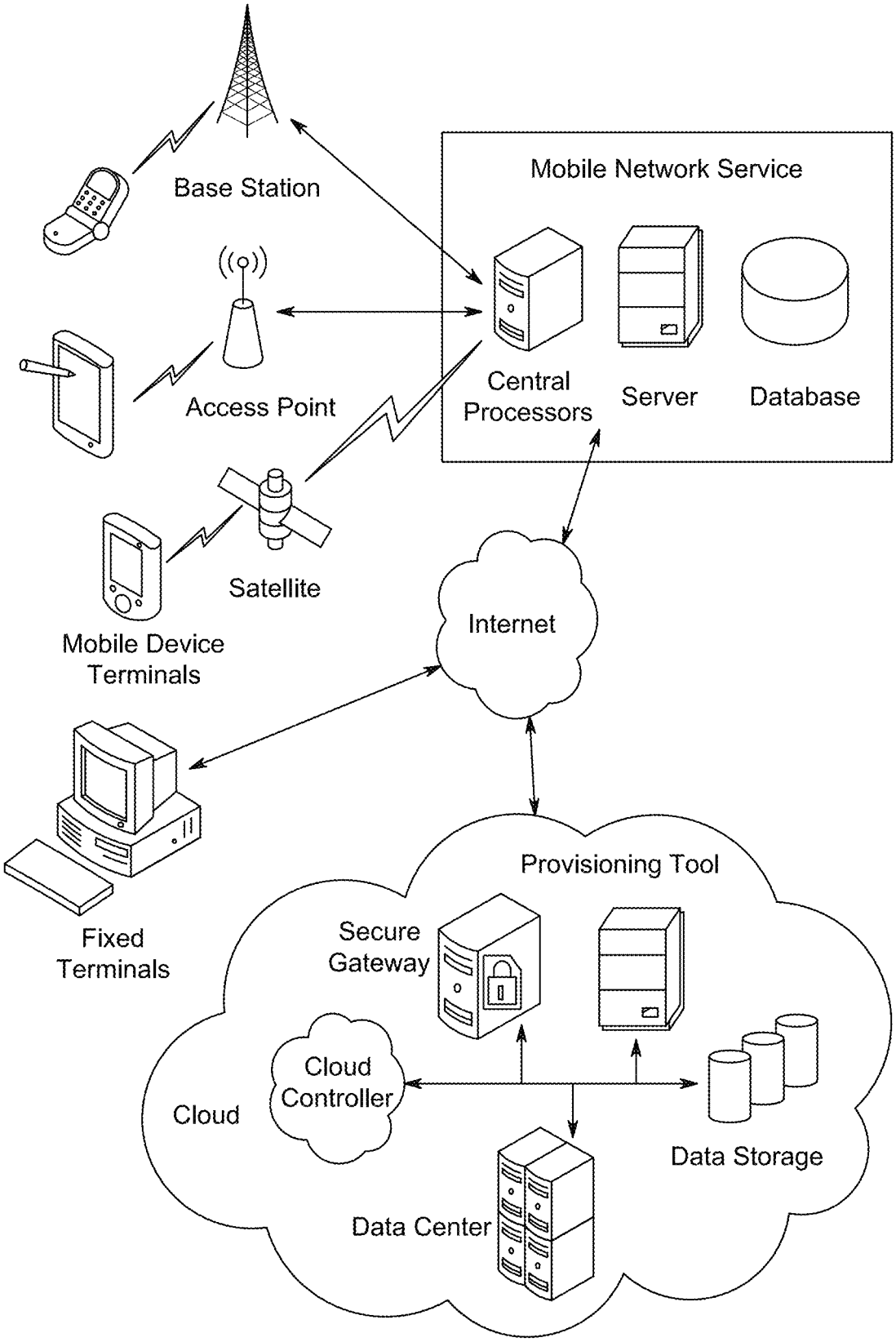
FIG. 9 is an illustration of a non-limiting example of distributed components which may share processing with a controller of the system, according to certain embodiments.

The functions and features described herein may also be executed by various distributed components of a system. For example, one or more processors may execute these system functions, wherein the processors are distributed across multiple components communicating in a network. The distributed components may include one or more client and server machines, which may share processing, as shown by FIG. 9, in addition to various human interface and communication devices (e.g., display monitors, smart phones, tablets, personal digital assistants (PDAs)). The network may be a private network, such as a LAN or WAN, or may be a public network, such as the Internet. Input to the system may be received via direct user input and received remotely either in real-time or as a batch process. Additionally, some implementations may be performed on modules or hardware not identical to those described. Accordingly, other implementations are within the scope that may be claimed.

The above-described hardware description is a non-limiting example of corresponding structure for performing the functionality described herein.

The aspects of the present disclosure are directed towards the smart cane 100 and the method 400 of using the smart cane 100. The smart cane 100, as described herein, includes a plurality of smart and adaptive features to assist the visually impaired individual. With the use of three or more ultrasonic sensors 212, the microcontroller 228, and the AI unit 306, the smart cane 100 may be able to detect multiple obstacles efficiently. Further, the smart cane 100 may also be able to classify the above mentioned obstacles and send an audio message via the audio device 304 to the individual regarding the classification, distance, and size of the obstacle present in from of the smart cane 100. Thus, the individual may traverse through an unknown territory with confidence, resulting in improved quality of life for the individual. The materials used in the construction of the smart cane 100 have been selected based on rigorous testing parameters, consequently, the smart cane 100 may have a durable construction. In some aspects, the top case assembly 115 and the hand grip 120 may also be made available for retro-fitments for existing walking canes. The above mentioned qualities may improve overall economical aspects of the smart cane 100.

Numerous modifications and variations of the present disclosure are possible in light of the above teachings. It is therefore to be understood that within the scope of the appended claims, the invention may be practiced otherwise than as specifically described herein.

The invention claimed is:

1. A smart cane for a blind and/or visually impaired individual, comprising:

a linear main frame rod (LMFR) having a first end, a second end, and a first internal cavity;

a linear extending rod (LER) having a first end, a second end, and a second internal cavity;

wherein the second end of the LMFR is connected to the first end of the LER;

a load-bearing feet disposed at the second end of the LER;

a top case assembly having a pivot at a connection to the first end of the LMFR; and a hand grip operably coupled to an outer circumferential side of the top case assembly;

wherein the hand grip is operably coupled to the LMFR via the top case assembly;

wherein the hand grip and the top case assembly are movable relative to the LMFR;

wherein a casing box of the top case assembly is in the form of an irregular hexagonal cell having an axis of symmetry that is coaxial with an axis of the hand grip, wherein two longest sides of the irregular hexagonal cell are opposite one another and extend lengthwise down the axis of the hand grip sloping away from the axis of the hand grip; and wherein two shortest sides of the irregular hexagonal cell are of equal length and are opposite one another, wherein one of the two shortest sides of the irregular hexagonal cell is proximal to the hand grip, and the other of the two shortest sides of the irregular hexagonal cell is proximal to the first end of the LMFR, wherein the two shortest sides of the irregular hexagonal cell are perpendicular to the axis of the hand grip, wherein the top case assembly comprises a casing box, three or more ultrasonic sensors, a camera module, an LED light, a charge module, a GPS module, a vibration motor, a Bluetooth module, a memory module, and a microcontroller containing an SOS system.

2. The smart cane of claim 1, wherein the LMFR has a length in a range of 400 to 1600 millimeters (mm), and a cylindrical cross section having an inner diameter in a range of 5 to 50 mm.

3. The smart cane of claim 1, wherein the LER has a length in a range of 200 to 900 mm, and a cylindrical cross section having an inner diameter in a range of 3 to 40 mm.

4. The smart cane of claim 1, wherein the inner diameter of the LMFR is greater than the inner diameter of the LER, and wherein the first end of the LER is within the first internal cavity of the LMFR.

5. The smart cane of claim 1, wherein the three or more ultrasonic sensors, the camera module, the LED light, the charge module, the GPS module, the vibration motor, the Bluetooth module, and the memory module are respectively, operably coupled to the microcontroller.

6. The smart cane of claim 1, wherein the charge module, the GPS module, the vibration motor, the Bluetooth module, the memory module, and the microcontroller are enclosed in the casing box.

7. The smart cane of claim 1, wherein the three or more ultrasonic sensors are configured to receive a first signal regarding obstacles detected on a walking surface, and wherein the microcontroller generates a second signal responsive to the first signal.

8. The smart cane of claim 7, wherein the vibration motor generates a vibration responsive to the second signal from the microcontroller, and wherein the vibration indicates that the obstacles are within a distance from the individual.

9. The smart cane of claim 1, wherein the GPS module is configured to generate a location of the smart cane and a current time, and wherein the microcontroller is configured to generate a location and time message to the Bluetooth module.

10. The smart cane of claim 1, wherein the camera module is configured to capture an image of an environment around the smart cane, wherein the memory module is configured to store the image, and wherein the microcontroller is configured to analyze the image to determine whether obstacles are within a distance.

11. The smart cane of claim 1, wherein the charge module is a rechargeable battery capable of providing necessary driving power for an operation of the smart cane, and wherein the rechargeable battery is capable of being charged by a wireless or wired charging module.

12. The smart cane of claim 1, wherein the casing box comprises a top side, a bottom side, the two longest sides, the two shortest sides, and two intermediate sides;

wherein the pivot is disposed on an outer surface of the bottom side of the casing box; and wherein the hand grip is disposed on an outer surface of a first shortest side of the casing box.

13. The smart cane of claim 12, wherein at least one of the three or more ultrasonic sensors is disposed on an outer surface of the top side of the casing box.

14. The smart cane of claim 12, wherein a port connected to the charge module for wired charging is in a first longest side of the casing box.

15. The smart cane of claim 12, wherein at least two of the three or more ultrasonic sensors are respectively disposed on two intermediate sides of the casing box.

16. The smart cane of claim 12, wherein the camera module and the LED light bulb are disposed spaced apart from each other on an outer surface of a second shortest side of the casing box.

17. The smart cane of claim 1, wherein the smart cane is at least made of ASTM B209 aluminum alloy 3003, ASTM D2000 rubber, and ABS plastic 3903000.

18. A smart cane for a blind and/or visually impaired individual, comprising:

a linear main frame rod (LMFR) having a first end, a second end, and a first internal cavity;

a linear extending rod (LER) having a first end, a second end, and a second internal cavity;

wherein the second end of the LMFR is connected to the first end of the LER;

a load-bearing feet disposed at the second end of the LER;

a top case assembly having a pivot at a connection to the first end of the LMFR; and a hand grip operably coupled to an outer circumferential side of the top case assembly;

wherein the hand grip is operably coupled to the LMFR via the top case assembly:

wherein the hand grip and the top case assembly are movable relative to the LMFR;

wherein a casing box of the top case assembly is in the form of an irregular hexagonal cell having an axis of symmetry that is coaxial with an axis of the hand grip, wherein two longest sides of the irregular hexagonal cell are opposite one another and extend lengthwise down the axis of the hand grip sloping away from the axis of the hand grip; and wherein two shortest sides of the irregular hexagonal cell are of equal length and are opposite one another, wherein one of the two shortest sides of the irregular hexagonal cell is proximal to the hand grip, and the other of the two shortest sides of the irregular hexagonal cell is proximal to the first end of the LMFR, wherein the two shortest sides of the irregular hexagonal cell are perpendicular to the axis of the hand grip, wherein the hand grip comprises a first button responsive to a first operation mode, a second button responsive to a second operation mode, and an SOS button responsive to an SOS operation mode, wherein:

the first operation mode is to detect obstacles within the distance, classify the obstacles, and generate a first alert;

the second operation mode is to turn on the camera module, describe the environment around the individual, and generate a second alert; and the SOS operation mode is to connect the GPS module to internet and initiate an SOS message.

* * * * *